US005916276A

United States Patent [19]

Walker, Jr.

[11] Patent Number: 5,916,276

[45] Date of Patent: Jun. 29, 1999

[54] PORTABLE WRINGING DEVICE

[76] Inventor: Clarence W. Walker, Jr., R.D. #1 Box 27B, Kittanning, Pa. 16201

[21] Appl. No.: 09/004,085

[22] Filed: Jan. 8, 1998

[51] Int. Cl.[6] ..... D06F 45/02; D06F 45/18; D06F 45/24

[52] U.S. Cl. ..... 68/247; 68/253 R; 68/257; 68/268; 68/269 R; 68/271; 68/273; 100/121; 100/171; 100/172

[58] Field of Search ..... 68/22 R, 22 A, 68/99, 126, 238, 239, 247, 253 R, 257, 264, 265, 268, 269 R, 272, 273, 271; 15/40, 262; 100/121, 171, 172, 173

[56] References Cited

U.S. PATENT DOCUMENTS

| | | | |
|---|---|---|---|
| 231,112 | 8/1880 | Smith | 100/171 X |
| 1,147,222 | 7/1915 | Doma | 100/172 X |
| 1,683,352 | 9/1928 | Hirner | 68/265 |
| 2,068,525 | 1/1937 | Williams | 68/264 X |
| 2,247,953 | 7/1941 | Leonard | 68/264 |
| 2,515,772 | 7/1950 | Hewlett | 100/173 X |
| 3,207,063 | 9/1965 | Major | 100/121 X |
| 3,377,827 | 4/1968 | Drury | 68/257 X |
| 4,554,806 | 11/1985 | Hewins | 68/257 |
| 4,928,505 | 5/1990 | Parks et al. | 68/269 R X |
| 5,320,035 | 6/1994 | Sanchez et al. | 100/172 X |

*Primary Examiner*—Philip R. Coe

[57] ABSTRACT

A wringing device is provided including a housing with a top face, a bottom face, a front face, a rear face and a pair of side faces formed therebetween thus defining an interior space. The top face has an entry opening formed therein and the front face has an exit opening formed therein. A roller assembly is situated within the housing. A drive mechanism is also positioned within the housing and remains in communication with the roller assembly for wringing a piece of cloth when put in the entry opening, whereafter the piece of cloth is dispensed from the exit opening.

19 Claims, 2 Drawing Sheets

PORTABLE WRINGING DEVICE

BACKGROUND OF THE INVENTION

1. Field of the Invention

The present invention relates to wringers and more particularly pertains to a new portable wringing device for allowing a user to wring a piece of cloth.

2. Description of the Prior Art

The use of wringers is known in the prior art. More specifically, wringers heretofore devised and utilized are known to consist basically of familiar, expected and obvious structural configurations, notwithstanding the myriad of designs encompassed by the crowded prior art which have been developed for the fulfillment of countless objectives and requirements.

Known prior art wringers include U.S. Pat. No. 4,554,806; U.S. Pat. No. 4,928,505; U.S. Pat. No. Des. 356,406; U.S. Pat. No. 4,920,877; U.S. Pat. No. 4,776,269; and U.S. Pat. No. 4,133,056.

In these respects, the portable wringing device according to the present invention substantially departs from the conventional concepts and designs of the prior art, and in so doing provides an apparatus primarily developed for the purpose of allowing a user to wring a piece of cloth.

SUMMARY OF THE INVENTION

In view of the foregoing disadvantages inherent in the known types of wringers now present in the prior art, the present invention provides a new portable wringing device construction wherein the same can be utilized for allowing a user to wring a piece of cloth.

The general purpose of the present invention, which will be described subsequently in greater detail, is to provide a new portable wringing device apparatus and method which has many of the advantages of the wringers mentioned heretofore and many novel features that result in a new portable wringing device which is not anticipated, rendered obvious, suggested, or even implied by any of the prior art wringers, either alone or in any combination thereof.

To attain this, the present invention generally comprises a housing having a rectangular configuration with a top face, a bottom face, a front face, a rear face and a pair of side faces formed therebetween thus defining an interior space. As shown in FIGS. 1*a* and 1*b*, the top face has a rectangular entry opening formed therein adjacent the rear face. The front face has a rectangular exit opening formed therein adjacent the bottom face. The housing further includes a pair of interior side walls coupled within the interior space of the housing in spaced parallel relationship with the side faces. As such, a pair of side compartments are defined. As best shown in FIG. 2, a removable ledge assembly is provided including a pair of cylindrical posts mounted to the front face of the housing below the exit thereof and extended outwardly therefrom. Associated therewith is a ledge having a large planar rectangular horizontally oriented plate with an inboard edge. The inboard edge has a small vertically oriented flange mounted thereto and extended downwardly therefrom. A pair of apertures are formed in the flange for releasably receiving the cylindrical posts. When coupled, the horizontally oriented plate extends outwardly from the front face of the housing in perpendicular relationship therewith. Also included is a roller assembly having a first cylindrical roller rotatably coupled between circular apertures formed in the interior side walls of the housing. As shown in FIGS. 3 & 4, a bottom edge of the first cylindrical roller is in general alignment with a top edge of the entry opening of the housing. A second cylindrical roller is rotatably and slidably situated within a pair of vertically oriented elongated slots formed in the interior side walls of the housing below the first cylindrical roller. A metal spring unit is provided including a pair of vertically oriented rods rotatably mounted to an axis about which the second cylindrical roller is situated. A coiled spring portion is positioned between the vertically oriented rods for urging the second cylindrical roller upwardly in abutment with the first cylindrical roller. Next provided is a drive mechanism including a first gear with a first diameter mounted to an axis of the first cylindrical roller within one of compartments of the housing A second gear with a second diameter less than the first diameter is rotatably mounted within one of the compartments of the housing and in engagement with the first gear. A third gear is included with a diameter less than the second diameter. The third gear is rotatably mounted within one of the compartments of the housing and in engagement with the second gear. A motor is coupled within the housing adjacent the top face thereof. During use, the motor is maintained in communication with the first gear for rotating the same upon the actuation thereof for effecting the rotation of the first cylindrical roller. This allows a piece of cloth to be situated within the entry opening to be wringed and dispensed from the exit opening. Situated on the top face of the housing is a switch. The switch has a first orientation for allowing the actuation of the motor and a second orientation for precluding the actuation of the motor. Finally, a drainage assembly is provided including an interior bottom wall coupled within the interior space of the housing in spaced relationship with the bottom face for defining a bottom compartment. As show in FIG. 5, the bottom wall has a plurality of apertures formed therein for allowing water to drain from the piece of cloth to the bottom compartment. Such water may be expelled from a drainage aperture formed in the front face of the housing during use.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable wringing device apparatus and method which has many of the advantages of the wringers mentioned heretofore and many novel features that result in a new portable wringing device which is not anticipated, rendered obvious, suggested, or even implied by any of the prior art wringers, either alone or in any combination thereof.

It is another object of the present invention to provide a new portable wringing device which may be easily and efficiently manufactured and marketed.

It is a further object of the present invention to provide a new portable wringing device which is of a durable and reliable construction.

An even further object of the present invention is to provide a new portable wringing device which is susceptible of a low cost of manufacture with regard to both materials and labor, and which accordingly is then susceptible of low prices of sale to the consuming public, thereby making such portable wringing device economically available to the buying public.

Still yet another object of the present invention is to provide a new portable wringing device which provides in the apparatuses and methods of the prior art some of the advantages thereof, while simultaneously overcoming some of the disadvantages normally associated therewith.

Still another object of the present invention is to provide a new portable wringing device for allowing a user to wring a piece of cloth.

Even still another object of the present invention is to provide a new portable wringing device that includes a housing with a top face, a bottom face, a front face, a rear face and a pair of side faces formed therebetween thus defining an interior space. The top face has an entry opening formed therein and the front face has an exit opening formed therein. A roller assembly is situated within the housing. A drive mechanism is also positioned within the housing and remains in communication with the roller assembly for wringing a piece of cloth when put in the entry opening, whereafter the piece of cloth is dispensed from the exit opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there arc illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1A:
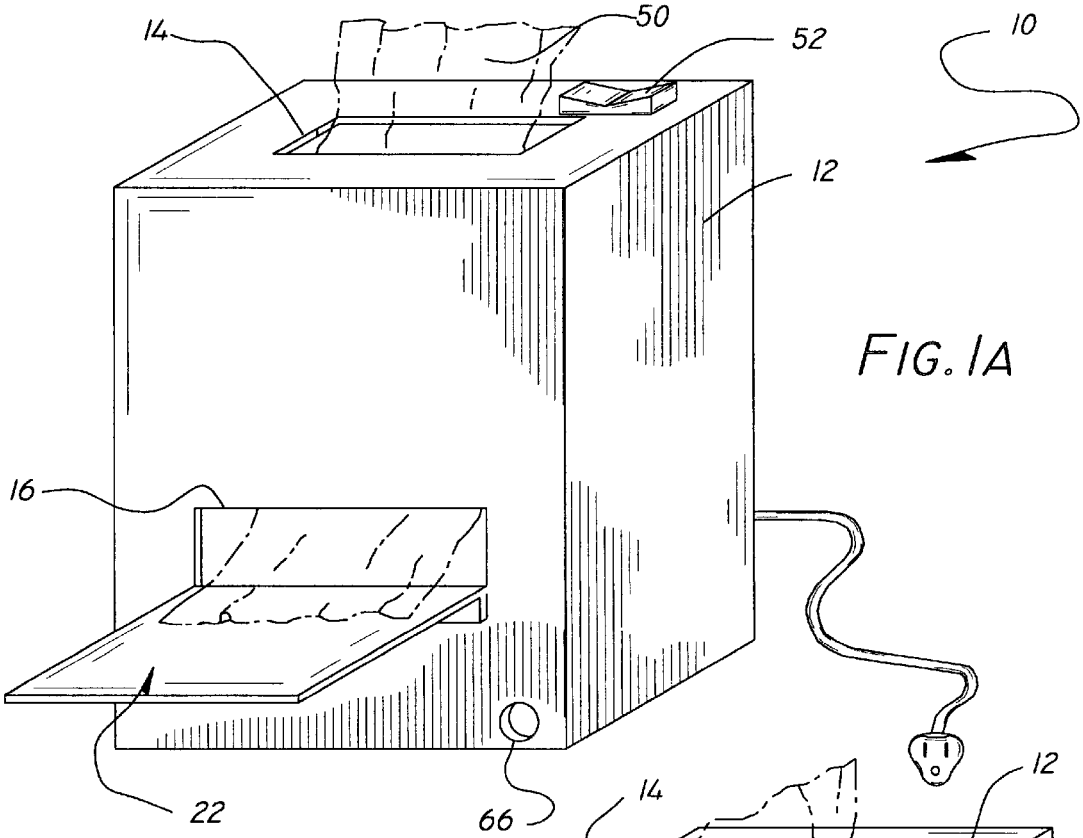
FIG. 1*a* is a front perspective view of a new portable wringing device according to the present invention.

With reference now to the drawings, and in particular to FIGS. 1 through 5 thereof, a new portable wringing device embodying the principles and concepts of the present invention and generally designated by the reference numeral 10 will be described.

Figure 1B:
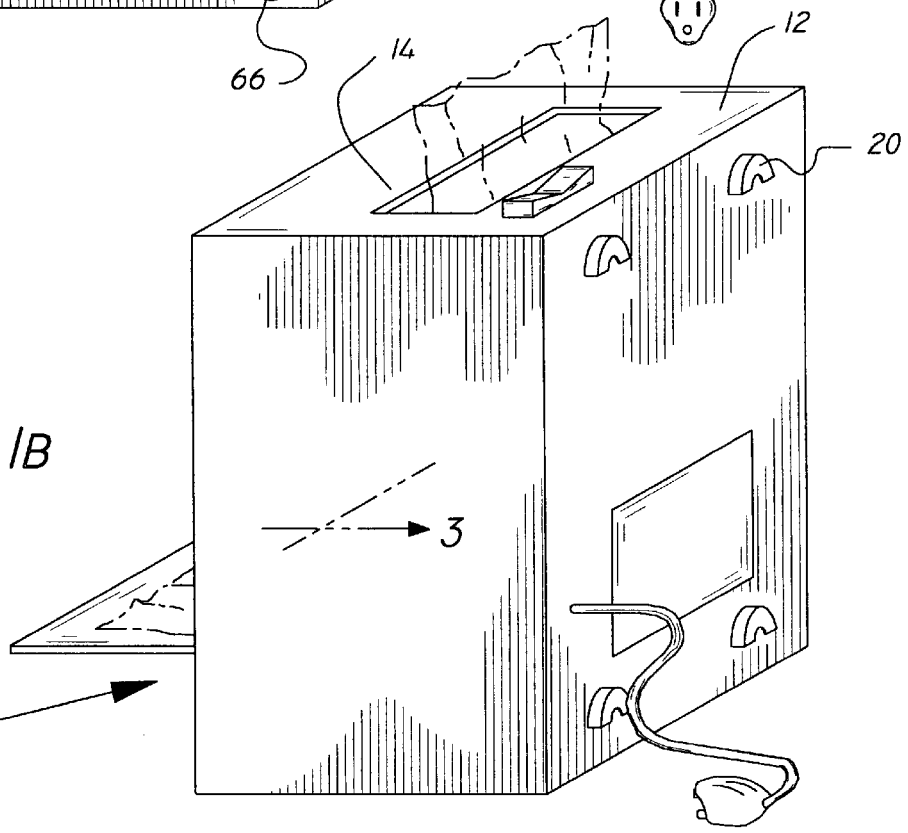
FIG. 1*b* is a rear perspective view of the present invention.

The present invention, as designated as numeral 10, includes a housing 12 having a rectangular configuration with a top face, a bottom face, a front face, a rear face and a pair of side faces formed therebetween thus defining an interior space. As shown in FIGS. 1*a* and 1*b*, the top face has a rectangular entry opening 14 formed therein adjacent the rear face. The front face has a rectangular exit opening 16 formed therein adjacent the bottom face. The housing further includes a pair of interior side walls 18 coupled within the interior space of the housing in spaced parallel relationship with the side faces. As such, a pair of side compartments are defined. To permit the housing to be mounted on wall, four mounting brackets 20 are situated at each of the four corners of the rear face of the housing. Further, a plurality of pads are ideally mounted to the bottom face.

Figure 2:
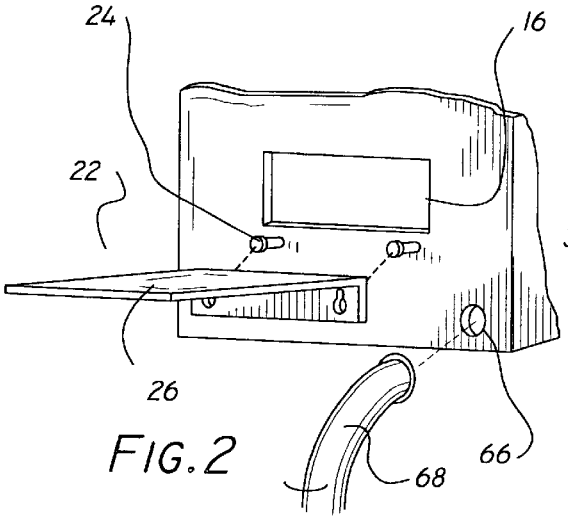
FIG. 2 is a close-up view of the removably ledge of the present invention.
Figure 3:
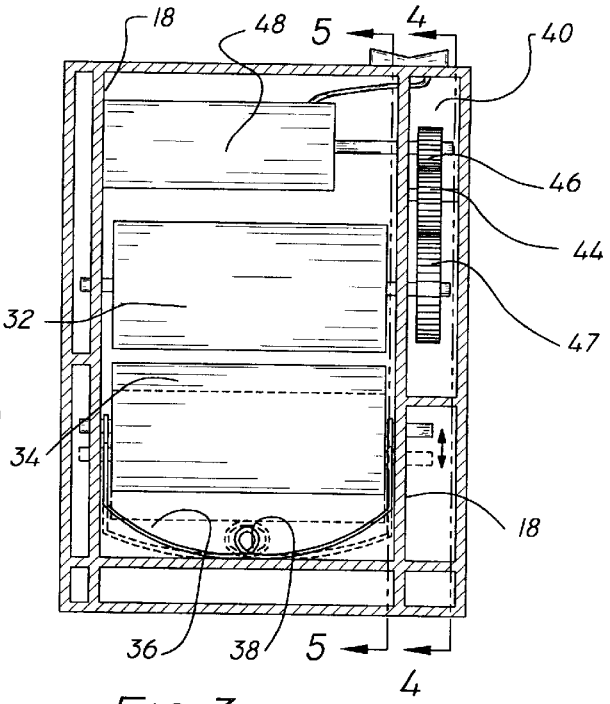
FIG. 3 is a front cross-sectional view of the present invention taken along line 3—3 shown in FIG. 1*b*.
Figure 4:
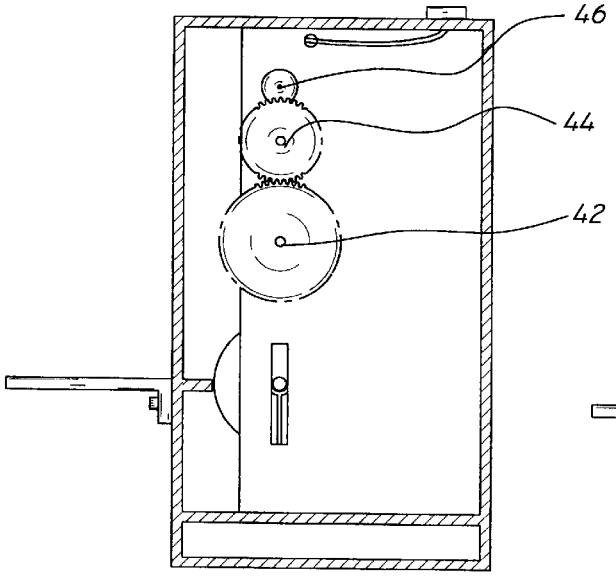
FIG. 4 is a side cross-sectional view of one of the side compartments of the present invention taken along line 4—4 shown in FIG. 3.

As best shown in FIG. 2, a removable ledge assembly 22 is provided including a pair of cylindrical posts 24 mounted to the front face of the housing below the exit opening thereof and extended outwardly therefrom. Associated therewith is a ledge 26 having a large planar rectangular horizontally oriented plate with an inboard edge. The inboard edge has a small vertically oriented flange mounted thereto and extended downwardly therefrom. A pair of apertures are formed in the flange for releasably receiving the cylindrical posts. When coupled, the horizontally oriented plate extends outwardly from the front face of the housing in perpendicular relationship therewith.

Figure 5:
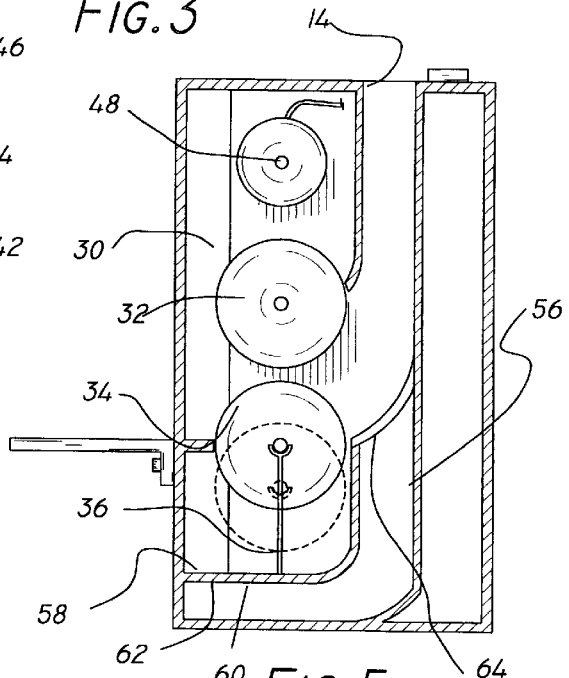
FIG. 5 is a side cross-sectional view of the present invention taken along line 5—5 shown in FIG. 3.

Also included is a roller assembly 30 having a first cylindrical roller 32 rotatably coupled between circular apertures formed in the interior side walls of the housing. As shown in FIG. 5, a bottom edge of the first cylindrical roller is in general alignment with a top edge of the entry opening of the housing. A second cylindrical roller 34 is rotatably and slidably situated within a pair of vertically oriented elongated slots formed in the interior side walls of the housing below the first cylindrical roller. A metal spring unit 36 is provided including a pair of vertically oriented rods rotatably mounted to an axis about which the second cylindrical roller is situated. A coiled spring portion 38 is positioned between the vertically oriented rods for urging the second cylindrical roller upwardly in abutment with the first cylindrical roller.

Next provided is a drive mechanism 40 including a first gear 42 with a first diameter mounted to an axis of the first cylindrical roller within one of compartments of the housing A second gear 44 with a second diameter less than the first diameter is rotatably mounted within one of the compartments of the housing and in engagement with the first gear. A third gear 46 is included with a diameter less than the second diameter. The third gear is rotatably mounted within one of the compartments of the housing and in engagement with the second gear. A motor 48 is coupled within the housing adjacent the top face thereof. During use, the motor is maintained in communication with the first gear for rotating the same upon the actuation thereof for effecting the rotation of the first cylindrical roller. This allows a piece of cloth 50 to be situated within the entry opening to be wringed and dispensed from the exit opening.

Situated on the top face of the housing is a toggle switch 52. The switch has a first orientation for allowing the actuation of the motor and a second orientation for precluding the actuation of the motor. For powering purposes, both an electric cord is provided in combination with a rechargeable battery. As an option, torque detecting circuitry is connected to the motor for reversing the rotating direction thereof upon the detection of a predetermined torque, as when a hand is caught between the rollers.

Finally, a drainage assembly 56 is provided including an interior bottom wall 58 coupled within the interior space of the housing in spaced relationship with the bottom face for defining a bottom compartment. As show in FIG. 5, the bottom wall has a plurality of apertures 60 formed therein for allowing water to drain from the piece of cloth to the bottom compartment. In the preferred embodiment, the bottom wall includes a front planar extent 62 and a removable rear arcuate extent 64, as shown in FIG. 5. The arcuate extent ideally extends upwardly and has a shape similar to the cylindrical rollers. The wringed water may be expelled from a drainage aperture 66 formed in the front face of the housing during use. As an option, a hose 68 may be removably connected to the drainage aperture to facilitate disposal of the water.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wringing device comprising, in combination:

a housing having a rectangular configuration with a top face, a bottom face, a front face, a rear face and a pair of side faces formed therebetween thus defining an interior space, the top face having a rectangular entry opening formed therein adjacent the rear face, the front face having a rectangular exit opening formed therein adjacent the bottom face, the housing further including a pair of interior side walls coupled within the interior space of the ho using in spaced parallel relationship with the side faces thus defining a pair of side compartments;

a removable ledge assembly including a pair of cylindrical posts mounted to the front face of the housing below the exit thereof and extending outwardly therefrom and a ledge having a large planar rectangular horizontally oriented plate with an inboard edge with a small vertically oriented flange mounted therto and extending downwardly therefrom with a pair of apertures formed therein for releasably receiving the cylindrical posts such that the horizontally oriented plate extends outwardly from the front face of the housing in perpendicular relationship therewith;

a roller assembly including a first cylindrical roller rotatably coupled between circular apertures formed in the interior side walls of the housing wherein a bottom edge of the first cylindrical roller is in alignment with a top edge of the entry opening of the housing, a second cylindrical roller rotatably and slidably situated within a pair of vertically oriented elongated slots formed in the interior side walls of the housing below the first cylindrical roller, and a metal spring unit including a pair of vertically oriented rods rotatably mounted to an axis about which the second cylindrical roller is situated and a coiled spring portion mounted between the vertically oriented rods for urging the second cylindrical roller upwardly in abutment with the first cylindrical roller;

a drive mechanism including a first gear with a first diameter mounted to an axis of the first cylindrical roller within one of compartments of the housing, a second gear with a second diameter less than the first diameter rotatably mounted within one of the compartments of the housing and in engagement with the first gear, a third gear with a diameter less than the second diameter rotatably mounted within one of the compartments of the housing and in engagement with the second gear, and a motor coupled within the housing adjacent the top face thereof and in communication with the first gear for rotating the same upon the actuation thereof for effecting the rotation of the first cylindrical roller thus allowing a piece of cloth that is situated within the entry opening to be wringed and dispensed from the exit opening;

a switch situated on the top face of the housing and having a first orientation for allowing the actuation of the motor and a second orientation for precluding the actuation of the motor; and a drainage assembly including an interior bottom wall coupled within the interior space of the housing in spaced relationship with the bottom face for defining a bottom compartment, the bottom wall having a plurality of apertures formed therein for allowing water to drain from the piece of cloth to the bottom compartment, wherein the same may be expelled from a drainage aperture formed in the front face of the housing.

2. A wringing device comprising:

a housing with a top face, a bottom face, a front face, a rear face and a pair of side faces formed therebetween thus defining an interior space, the top face having an entry opening formed therein, the front face having an exit opening formed therein;

a roller assembly situated within the housing;

a drive mechanism situated within the housing and in communication with the roller assembly for wringing a piece of cloth when put in the entry opening, whereafter the piece of cloth is dispensed from the exit opening; and a drainage assembly having an interior bottom wall coupled within the interior space of the housing in spaced relationship with the bottom face for defining a bottom compartment, the bottom wall having a plurality of apertures formed therein for allowing water to drain from the piece of cloth to the bottom compartment.

3. A wringing device as set forth in claim 2 wherein the drive mechanism is powered by a battery.

4. A wringing device as set forth in claim 2 wherein the drive mechanism includes a plurality of gears.

5. A wringing device as set forth in claim 4 wherein the gears each have a different diameter.

6. A wringing device as set forth in claim 4 wherein the gears are situated within a compartment within the housing.

7. A wringing device as set forth in claim 2 and further including a removable ledge removably coupled below the exit opening.

8. A wringing device as set forth in claim 2 wherein the roller assembly includes a roller which has an axis that is slidable along a vertical axis, wherein a spring is in communication therewith for urging the roller in abutment with another roller.

9. A wringing device as set forth in claim 8 wherein the spring mechanism includes a single metal wire with a pair of ends coupled to ends of the associated roller and a central extent with a coiled portion.

10. A wringing device as set forth in claim 2 wherein the water may be expelled from a drainage aperture formed in the housing.

11. A wringing device comprising:

a housing with a top face, a bottom face, a front face, a rear face and a pair of side faces formed therebetween thus defining an interior space, the top face having an entry opening formed therein, the front face having an exit opening formed therein;

a roller assembly situated within the housing;

a drive mechanism situated within the housing and in communication with the roller assembly for wringing a piece of cloth when put in the entry opening, whereafter the piece of cloth is dispensed from the exit opening; and a removable ledge including an inboard edge removably coupled to the housing below the exit opening.

12. A wringing device as set forth in claim 11 wherein the drive mechanism is powered by a battery.

13. A wringing device as set forth in claim 11 wherein the drive mechanism includes a plurality of gears.

14. A wringing device as set forth in claim 13 wherein the gears each have a different diameter.

15. A wringing device as set forth in claim 13 wherein the gears are situated within a compartment within the housing.

16. A wringing device as set forth in claim 11 wherein the roller assembly includes a roller which has an axis that is slidable along a vertical axis, wherein a spring is in communication therewith for urging the roller in abutment with another roller.

17. A wringing device as set forth in claim 16 wherein the spring mechanism includes a single metal wire with a pair of ends coupled to ends of the associated roller and a central extent with a coiled portion.

18. A wringing device as set forth in claim 11 and further included is a drainage assembly having an interior bottom wall coupled within the interior space of the housing in spaced relationship with the bottom face for defining a bottom compartment, the bottom wall having a plurality of apertures formed therein for allowing water to drain from the piece of cloth to the bottom compartment.

19. A wringing device as set forth in claim 18 wherein the water may be expelled from a drainage aperture formed in the housing.

* * * * *